US005881594A

United States Patent [19]

Hughes et al.

[11] Patent Number: 5,881,594

[45] Date of Patent: Mar. 16, 1999

[54] METHOD AND APPARATUS FOR IMPARTING STRENGTH TO A MATERIAL USING SLIDING LOADS

[75] Inventors: Darcy Anne Hughes, Fremont; Daniel B. Dawson, Pleasanton; John S. Korellis, Livermore, all of Calif.

[73] Assignee: Sandia Corporation, Livermore, Calif.

[21] Appl. No.: 853,973

[22] Filed: May 9, 1997

Related U.S. Application Data

[63] Continuation of Ser. No. 389,852, Feb. 17, 1995, abandoned.

[51] Int. Cl.[6] ..... B21D 21/00

[52] U.S. Cl. ..... 72/364; 72/379.2; 72/374; 148/902; 478/577

[58] Field of Search ..... 72/364, 379.2; 428/577; 72/324; 148/902

[56] References Cited

U.S. PATENT DOCUMENTS 4,520,647 6/1985 Economy et al. ..... 72/365

5,454,888 10/1995 Gallagher, Jr. ..... 148/648

5,496,425 3/1996 Gallagher, Jr. ..... 148/651

*Primary Examiner*—Johann Richter

*Assistant Examiner*—Joseph Murray

*Attorney, Agent, or Firm*—Kurt Olsen; Timothy Evans

[57] ABSTRACT

A method of enhancing the strength of metals by affecting subsurface zones developed during the application of large sliding loads. Stresses which develop locally within the near surface zone can be many times larger than those predicted from the applied load and the friction coefficient. These stress concentrations arise from two sources: 1) asperity interactions and 2) local and momentary bonding between the two surfaces. By controlling these parameters more desirable strength characteristics can be developed in weaker metals to provide much greater strength to rival that of steel, for example.

21 Claims, 6 Drawing Sheets

METHOD AND APPARATUS FOR IMPARTING STRENGTH TO A MATERIAL USING SLIDING LOADS

This is a continuing application of prior patent application Ser. No. 08/389,852 originally filed Feb. 17, 1995, now abnadoned, from which priority is claimed.

BACKGROUND AND DISCUSSION OF THE INVENTION

The government has rights in this invention pursuant to contract no. DE-AC04-94AL8500 between the U.S. Department of Energy and Sandia Corporation.

The present invention satisfies two broad demands in material science. First, it satisfies the constant demand for new, easily manufacturable materials with integral subsurface hardness. Applications for hard integral subsurface regions include, but are not limited to, electromechanical devices and switches, electronic connectors, valves, light weight engine components, dies, surgical blades and any component which requires adherent erosion and abrasion-resistant surfaces combined with a tough base. Second, there is tremendous interest in creating new materials for micromachines to advance the current technology beyond silicon parts.

For certain applications of metals it is preferable to have a consistent, relatively deep hard surface that is abrasive resistent while being relatively easy to form. Many materials with hard surfaces, while having some of these characteristics, are deficient. Other materials which may have many of these desirable characteristics, are expensive or become expensive when subjected to the working requirements needed to achieve the desired product. Many metals, while ductile or otherwise easily formed, are not sufficiently hard, or suffer from regions of hardness at the surface that are too thin or inconsistent for practical use. Although in some instances there are methods for hardening the surface of a particular metal, such treatments are often complex, time consuming and expensive, making their use in a commercial environment difficult or impossible.

The invention described herein has overcome many of the problems discussed above. A new material as well as a method for making that material has been developed that produces the desired qualities of a wear resistant surface with substantially increased hardness, relative ductility, metallurgical stability, cost effectiveness, and manufacturing. flexibility. Such features can be achieved by imparting fine structures beneath the surface of the material. In addition to strength, fine structures also have the attribute of increased ductility, toughness, and fatigue resistance, making them strong candidates for surface structures and micro-components.

We have discovered that a new class of high strength, very hard, ductile, nanostructured material is created by intense confined shear deformation. For example, extremely fine microstructures of less than 20–100 nm spacing were induced by this process in pure copper. This translates to a strength level 30–60 times the initial strength based on a size scale of 30 nm and using scaling laws that relate strength to microstructural size. Consequently, nominally pure copper in this new state rivals the strength of many steels. These values represent enormous changes from previously observed or postulated values. This process can be used with many other materials including solid solution, precipitation hardened metals and others since these materials show similar structures when subjected to large strain deformations.

Although there are several existing ways to make nanocrystalline materials and hard surfaces, these current processes frequently rely on chemical or thermal processing, or both, to achieve the end result. Furthermore, unwanted pores and impurities are often incorporated when electrodeposition, gas phase deposition or either rapid solidification or attrition techniques followed by consolidation are used to create nanostructured materials. In contrast this new process relies on intense confined deformation and the previously unrealized strengths this deformation imparts. Chemical or thermal processing can thereby be avoided or minimized. It may also prove possible to create nanomaterials without pores or unwanted impurities since we are transforming a monolithic material.

Mechanical methods are also known which change the subsurface structure. Several methods for confined deformation exist such as wire drawing or shear under hydrostatic pressure. However, these methods produce microstructure with a subgrain size which is four to five times larger than is produced using the new method. This refinement translates into 2 to 4 times the strength levels previously obtained by deformation processes. Thus, the previous confined deformation methods in comparison to our new method produce weaker materials with larger subgrains.

Other mechanical methods are known that modify the surface characteristics of a material. An example of such a method is described and claimed in U.S. Pat. No. 4,520,647. That method involves placing the material between two rollers and applying a deformational force to the rollers which exceeds the elastic limit of the material. The rollers, which have smooth surfaces, rotate at the same rate of the material. The primary emphasis in this method was to modify the surface roughness. Other characteristics, such as strength, were deemed incidental. Also, though plastic deformation is mentioned, it is claimed to occur only in the asperity peaks. In addition, this method does not disclose an ability to control the depth of plastic deformation. In contrast, we have discovered a method that can control the depth of the strengthened subsurface. In the newly discovered method, plastic deformation occurs beyond the asperity peaks. Finally, our method is mechanically distinct since it involves sliding, or slip, rather than simply rolling.

The new material discovered is produced as a thick surface layer 2–15 $\mu$m deep which develops during sliding under a heavy load over a confined area. The layers formed during sliding are caused by the interaction of the surface being treated with the surface asperities of the counterface platen and adhesion. Because the material is confined, tremendous shear strains of at least 2500% are made possible, without cracking, leading to the development of high angle dislocation boundaries spaced less than tens of nanometers apart.

Quantifying the structures' morphologies, crystallographic orientation, and size scales further enables one to determine the micro-mechanical mechanisms which are creating these structures. With these measuring techniques, and their relationship to the parameters that effect the desired characteristics in the subsurface structures, one can control the hardness features sought. The significant parameters in creating these structures are counterface asperity geometry., normal pressure, sliding speed and distance, counterface material, and local friction. Those parameters control the depth of the nanostructured layers, the size scale of the microstructure, the uniformity of the layers, the gradient in microstructural size scale with depth and thus strength. By placing the surface to be treated under a heavy normal pressure, in a confined area, over a relative large portion of surface, one can control the strengthening of surface layers of the metal to a depth heretofore unachievable with the desired consistency. For this purpose a relatively blunt tool is utilized which is preferably flat or nearly flat.

Machines for applying combined normal and shear pressures to metal are known. In particular, Sandia has developed and used a flat plate friction tester which applies normal and shear pressures to surfaces of metal blocks. However, these tests were conducted to empirically describe the mechanics of friction and not to create fine scale surface structures. In contrast, we have discovered a relation between the subsurface material properties and control of the manufacturing parameters discussed above.

The process for changing the surface structure can also be used to incorporate additional finely dispersed metal alloying elements in a consistent and predictable manner to create a new material. In some applications it may be desirable to minimize this elemental exchange while in others, a controlled exchange may be desirable. Smaller sliding distances, lower speeds, and choice of counterface material can minimize material exchange. The processing can also be controlled to prevent surface wave geometries which are likely to be folded over. Undesirable particles from the counterface, oxides and voids can be trapped within those folds creating porosity and crack-like flaws.

Finally, lithography patterning and wet chemical techniques can be used to chemically mill parts with micro features from modified surfaces. The nanometer size scale of the deformation microstructure is ideally suited to the fine scale of the features which would be micro-machined. The high strength and relative ductility of these new materials are key attributes for structural micro-components.

BRIEF DISCUSSION OF THE DRAWINGS

DETAILED DISCUSSION OF PREFERRED EMBODIMENTS

Surface modification described herein below is used to create a new material with subsurface structure that has not been before achieved at the depths described. Surface modification is made by a tool, or slider, which applies normal and shear pressures over confined areas of a metal block. The normal load is controlled while allowing some normal displacement. The tool is a rigid object with a surface which is flat or blunt but nominally smooth. The tool surface has fine scale asperity geometry which is tailored in terms of wedge angle and wavelength of the asperities. The design of these asperities is guided by models of asperity surface interactions. This fine scale tailoring of our tooling is achieved by blanchard grinding but greater control can be obtained using e-beam lithography for patterning combined with our electroforming techniques. Diamond turning, fine scale sand blasting and grinding are other methods for varying the asperity geometry of the tool. The methods and apparatus employed can be used on a multitude of different materials, although the following discussion is primarily directed to copper. Specifically, we have applied the sliding treatment and observed evidence of strengthening in blocks of stainless steel, 6061 aluminum alloy and precipitation-strengthened copper-beryllium alloy. These metals were selected because they have well known industrial applications. In addition, their material properties are established.

The main steps of the process include the following steps: preparing the copper blocks, preparing the steel tool, and applying a combined normal-shear force to the block-tool interface. In addition to the process actually employed, a discussion of techniques used to measure and quantify the material parameters is included.

Figure 1:
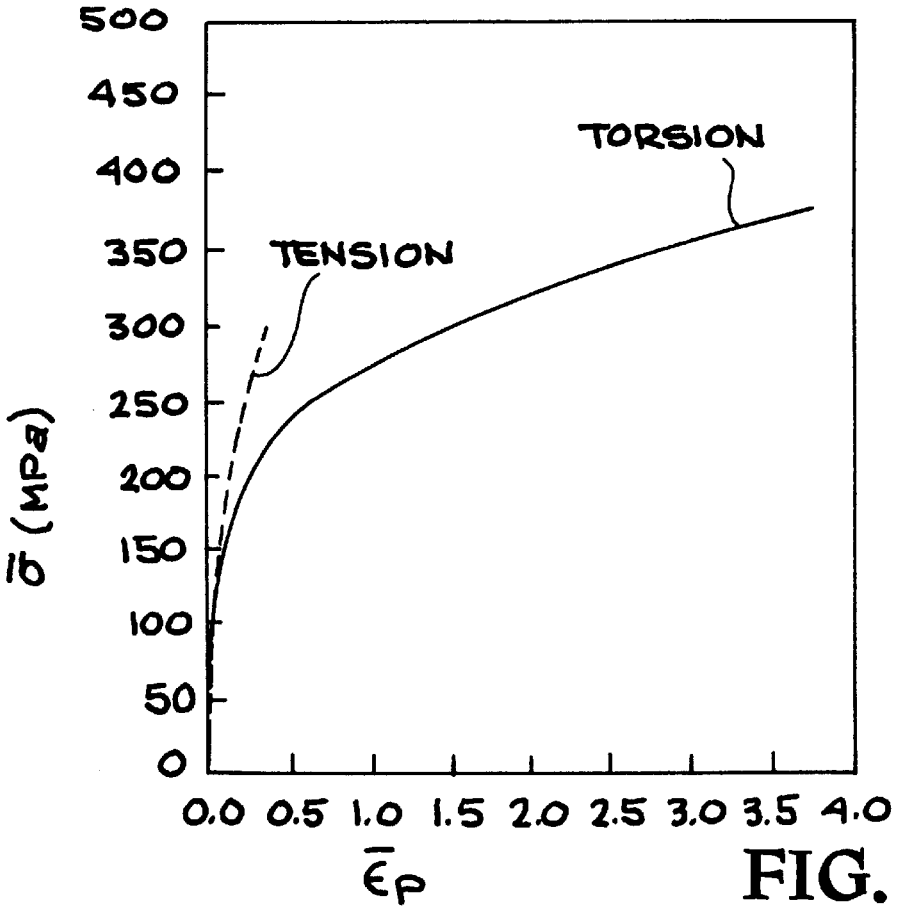
FIG. 1 shows a graph of a true stress-strain behavior of copper during static loading for both tensile and thin wall tubed torsion deformation.
Figure 4:
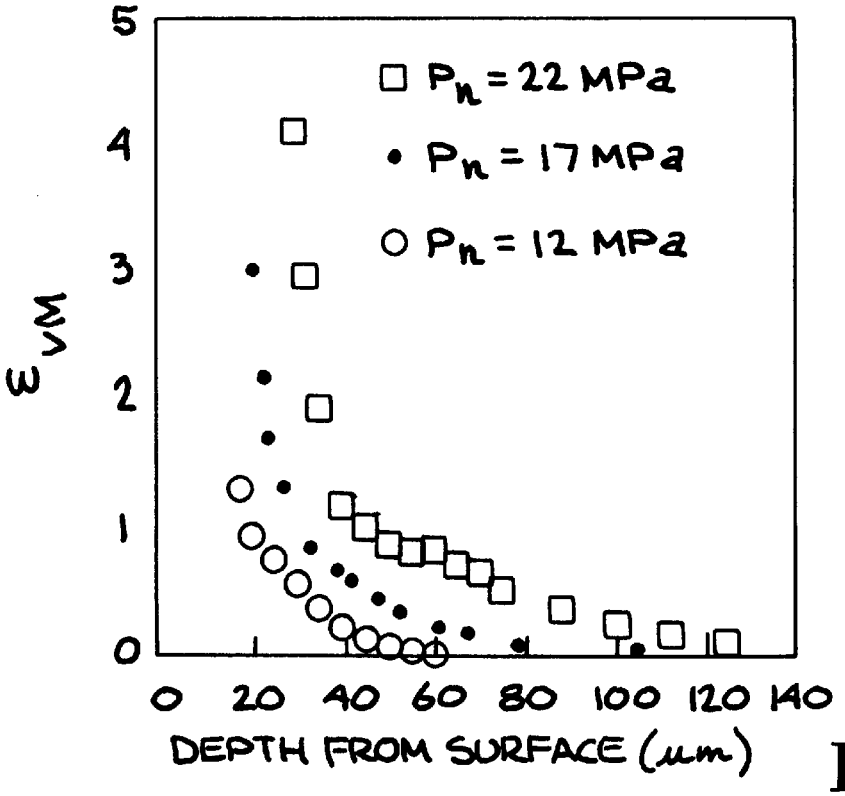
FIG. 4 shows the strain gradient caused by the sliding method as a function of normal pressure.

Copper blocks, with a 25.4×25.4 mm surface area, are formed from high purity OFE copper 10100 in the full hard condition. The surface finish on these blocks was machined so that the last two machining cuts were less than 0.013 mm each. Surface roughness was then measured to be 0.3 $\mu$m $R_a$ (arithmetic mean deviation of the roughness profile). The machined blocks were subsequently recrystallized at 873 K in vacuum for one hour to a grain size of 100 $\mu$m. This recrystallization step removed all machining damage from the surface before sliding. The stress-strain plots of the recrystallized copper under quasi-static conditions for both tension and torsion are shown in FIG. 1. The yield stress in tension for this material is 30 MPa. Just before the sliding treatment the recrystallized copper blocks are dipped for 3–5 seconds in concentrated glow brite acid, rinsed first in water then in isopropyl alcohol to remove the previous oxide layer. Samples are stored in the isopropyl alcohol until loads were applied; storage did not exceed four hours. This procedure should provide a thin and more controlled oxide layer during operation of the equipment.

A tool which may be used to produce the desired microstructure is a hardened 4340 steel counterface slider. This tool has a blanchard ground surface finish with a measured surface roughness of $R_q$=1.4 $\mu$m (root mean square deviation of the roughness profile), $R_a$=1 $\mu$m, (arithmetic average of the absolute values of the measured profile height) and an average maximum peak height of $R_p$=3.0 $\mu$m. The average number of peaks which are greater than 0.5 $\mu$m above the zero line is 7.7/mm, while the average number of peaks which are greater than 1.25 $\mu$m above the zero line is 2.0/mm. The wedge angle of the asperities was estimated as between 1° and 5°.

Figure 2:
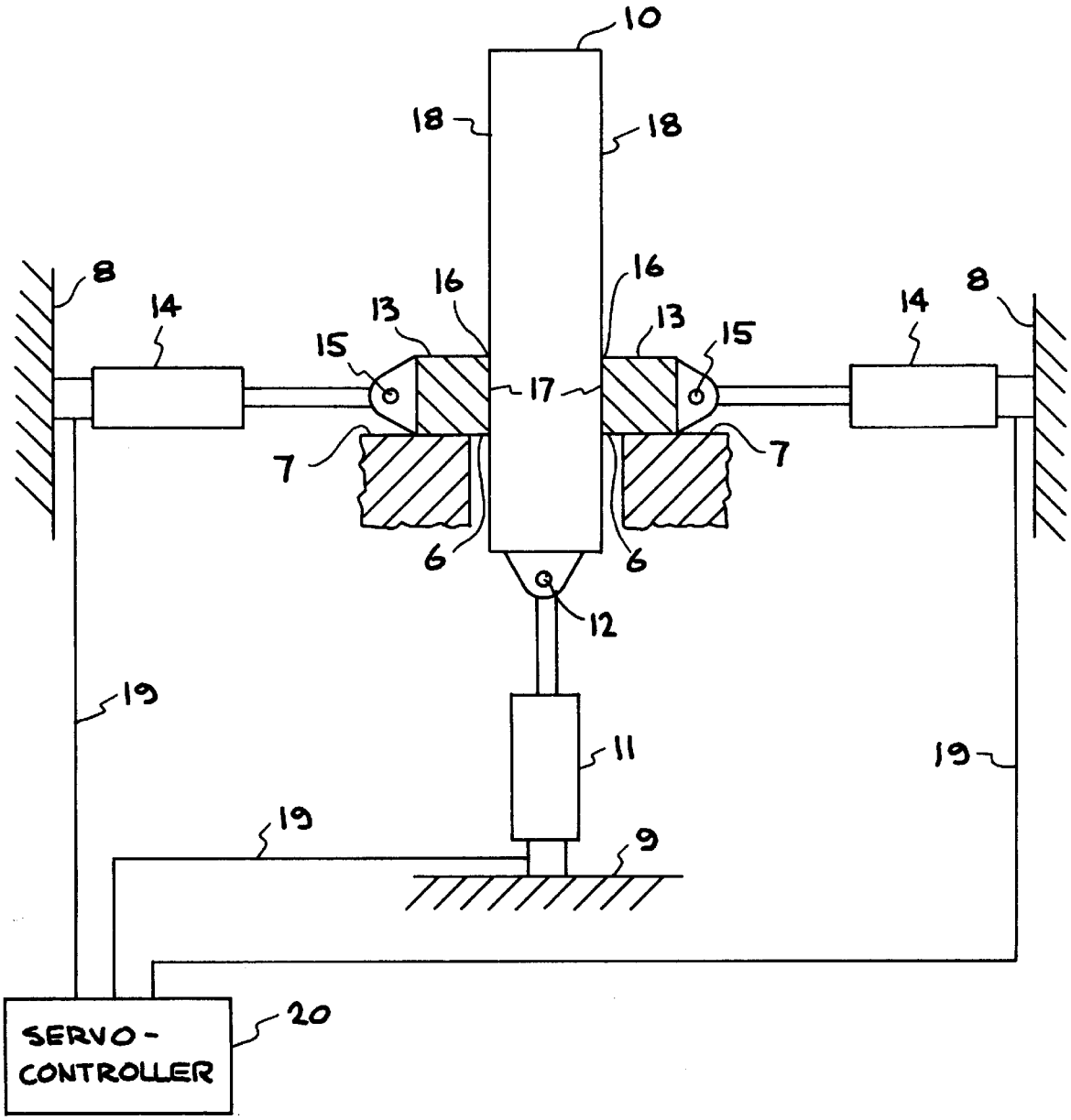
FIG. 2 is a schematic of an apparatus used in imparting loads on the specimen.

FIG. 2 shows a schematic of the surface deformation apparatus. The tool (10) is attached via an axial linkage (12) to an axial hydraulic piston (11). The axial hydraulic piston (11) is attached to an axial reactionary surface (9). Two normal hydraulic pistons (14) on opposing sides of the tool (10) are attached to the blocks (13) via normal linkages (15). The normal hydraulic pistons are attached to normal reactionary surfaces (8). The normal reactionary surfaces (8) and the vertical reactionary surface (9) are sufficiently rigid in relation to each other in order to minimize unwanted relative displacement. In addition, axial block restraining surfaces (7) contact the axial block faces (6) to prevent axial displacement of the blocks (13). The block restraining surfaces (7) are not attached to the blocks (13) and allow normal translation of the block (13) and axial translation of the tool (10).

The normal hydraulic (14) pistons hold the blocks (13) against the tool (10) which together form a block-tool interface (16). The blocks (13) are held to enable the prepared surface of the block (17) and the prepared surface of the tool (18) to be in direct contact at the block-tool interface (16). Electrical signal carriers (19) are attached to the normal hydraulic pistons (8) and the axial hydraulic piston (12). A servo-controller (20) attaches to the electrical signal carriers (19).

In this embodiment the apparatus applies a shear and normal force to the block-tool interface (16). First, the servo-controller (20) actuates the normal hydraulic pistons (14) which impart a normal force to the blocks (13) and create pressure at the block-tool interface (16). Second, the servo-controller (20) actuates the axial shear hydraulic piston (11) which imparts axial force to the tool (10) and imparts a shear force to the block-tool interface (16). As the axial shear force is increased the tool (10) axially translates in relation to the blocks (13). The combined shear and normal forces which result at the block-tool interface (16) induce the formation of the fine structure in the areas of the block near the block-tool interface (16). Throughout the process, the servocontroller (20) also measures and records the sliding speed, normal force, and shear force at the block-tool interface (16). The normal pressure, sliding speed and sliding length used are shown in Table 1.

TABLE 1

Parameters Used to Manufacture Strengthened Material

| Normal Pressure (MPa) | Sliding Speed (mm $s^{-1}$) | Sliding Distance (mm) |
|---|---|---|
| 12.0 | 25 | 120 |
| 21.5 | 25 | 120 |
| 16.7 | 0.25 | 120 |

The range of applied normal pressure is selected as a percentage of the yield pressure of the block material. We have found that a range of pressures between 20% and 75% of yield produce the most advantageously strengthened subsurface structure.

We are also aware of at least four variants to the preferred embodiment discussed above. The four variants are applications to non-flat surfaces, multiple sliding passes, fixed normal displacements, and alloying. In addition, we have recognized that some of these embodiments are compatible with each other.

The first variant to the preferred embodiment applies blocks or tools with non-flat surface to a corresponding tool or block surface. This corresponding surface can be flat or non-flat. For example, this variant includes cylindrical tool surfaces applied to flat block surfaces. It also includes flat tool surfaces applied to cylindrical tool surface. As in the preferred embodiment, the tool is pullled and the block-tool interface is subjected to a combination of normal and shear pressures. In addition, this variant includes cylindrical surfaces applied to bores. Here, normal and shear pressures can be applied by combining axial, rotational, and radial motion. For cylindrical surfaces, the Herztian stresses would elastically deform the curvature to a locally flat region. However, this variant is not restricted to cylindrical surfaces. Any surface will suffice if its local curvature can elastically deform to match the corresponding surface. Thus, this variant includes the following block-tool combinations: flat tool/non-flat block, non-flat tool/flat block, and non-flat tool/non-flat block.

A second variant to the preferred embodiment employs multiple sliding passes of the tool against the block. In the preferred embodiment, the sliding process is a single continuous pass of a finite length. In contrast, the second variant uses sequential passes to further enhance the strength of the subsurface region. There are at least two applications where this variant can be employed. First, multiple sliding passes may be required where spatial constraints do not allow for a long, continuous pass. Second, multiple passes may be used that vary the scale of asperities of each pass. For example, the second pass may consist of applying a tool with asperities that are much finer than the second. The results of this second application could also be conducted with a single tool that has an asperity fineness that varies in the sliding direction.

A third variant involves fixing the normal displacement and allowing the normal pressure to develop as required. This embodiment can be employed by substituting a tapered channel for the blocks. The tool is a matching tapered obelisk which seats into the tapered channel. An axial force is then applied to the tool which allows a normal and shear pressure between the block-tool interface to develop.

A fourth variant to the preferred embodiment involves the process of compositionally mixing alloying elements into the surface layers in a consistent and predictable manner to arrive at a new material. In the preferred embodiment discussed above, manufacturing parameters are selected for slight material exchange from the tool to the block. Evidence of alloying was observed as an extremely fine dispersion of 1% iron in the copper. The iron was uniformly distributed within the fine lamellar boundaries. For a 12 MPa normal pressure, amounts of detected iron and oxygen are included in Table 2 as a function of depth below surface.

TABLE 2

Results of EDS analysis of the Cu block tested at 12 MPa normal pressure. Spot size was 0.33 $\mu$m

| Depth below surface ($\mu$m) | Iron (wt. %) | Oxygen (wt. %) |
|---|---|---|
| 0.17 | 1.0 ± 0.3 | Undetected |
| 0.17 | 1.0 ± 0.2 | Undetected |
| 0.5 | 1.0 ± 0.5 | Undetected |
| 0.6 | 1.3 ± 0.2 | Undetected |
| 0.8 | 0.7 ± 0.2 | Undetected |
| 2.2 | 1.1 ± 0.2 | Undetected |
| 6.7 | 0.2 ± 0.1 | Undetected |
| 20 | Undetected | Undetected |

However, it may be desirable to control exchange of the material. By controlling parameters discussed above one can control the degree of material exchange and thus, produce alloys which combine the material of the tool and block.

Because the new material layer is very thin, material properties must be obtained by observing the subsurface structure. Material properties are determined by using scaling laws that relate subgrain size to strength. After processing on the surface deformation apparatus, one of each pair of blocks is electroplated using a Woods nickel strike followed by copper to protect the surface during metallography. The plated samples are cross-sectioned, treated and sliced for viewing by scanning electron microscopy (SEM) and transmission electron microscopy (TEM). The SEM is employed to reveal the depth and localized heterogeneity of subsurface deformation along the entire 25.4 mm sample length, while TEM was used to study the fine details of the subsurface structures at higher magnifications.

Figure 3A:
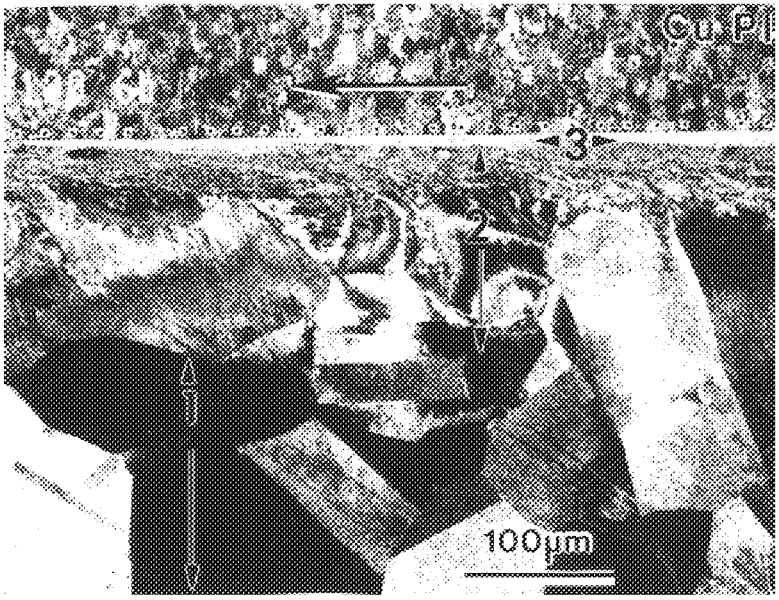
FIG. 3 is a micrograph showing deformation of subsurface layers at a normal pressure of 17 MPa and a sliding speed of 0.25 mm/s; Regions 1, 2, and 3 (discussed in text) are shown.
Figure 3B:
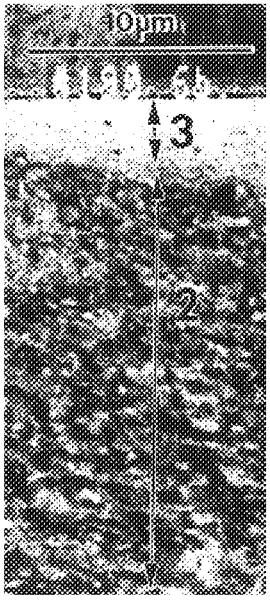

Evidence of the new material, increased subgrain fineness, and the corresponding strength increase in subsurface strength for this material are shown in FIGS. 3–8. All of the SEM and TEM micrographs are viewed from samples cross-sectioned along the longitudinal side parallel to the sliding direction. The backscattered SEM micrograph FIG. 3 provides an overview of the depth of the subsurface regions hardened by the mechanical strengthening process and also the deeper layers in the material which are unaffected by this process. Three regions are thus shown in FIG. 3: 1) a region far from the surface which is unaffected by the mechanical hardening process, 2) a transition region which has been affected by the process but does not exhibit the extreme fineness of the microstructural size scale and strength, and 3) the region which contains the new material with an extremely fine size scale. In FIG. 3, the fineness of the crystal structures is related to the fineness of the black and white contrast changes. The bottom left region of FIG. 3, at a depth of 300 $\mu$m below the surface, shows large grains with even shading indicating that this region has not been affected by the mechanical process. At depths between about 200 to 15 $\mu$m (exact depths depend on applied normal pressure), the micrograph from the bottom to the top of the dotted line shows an ever decreasing spacing between black and white contrast fringes, indicating an increasing fineness in the crystal structure with decreasing subsurface depth. The changing crystal size scale is caused by the stress and strain gradients imposed by the sliding mechanical process. Examples of the strain gradients as a function of depth and normal pressure are plotted in FIG. 4. The strain gradients were measured using the displacement of annealing twin boundaries.

Figure 5:
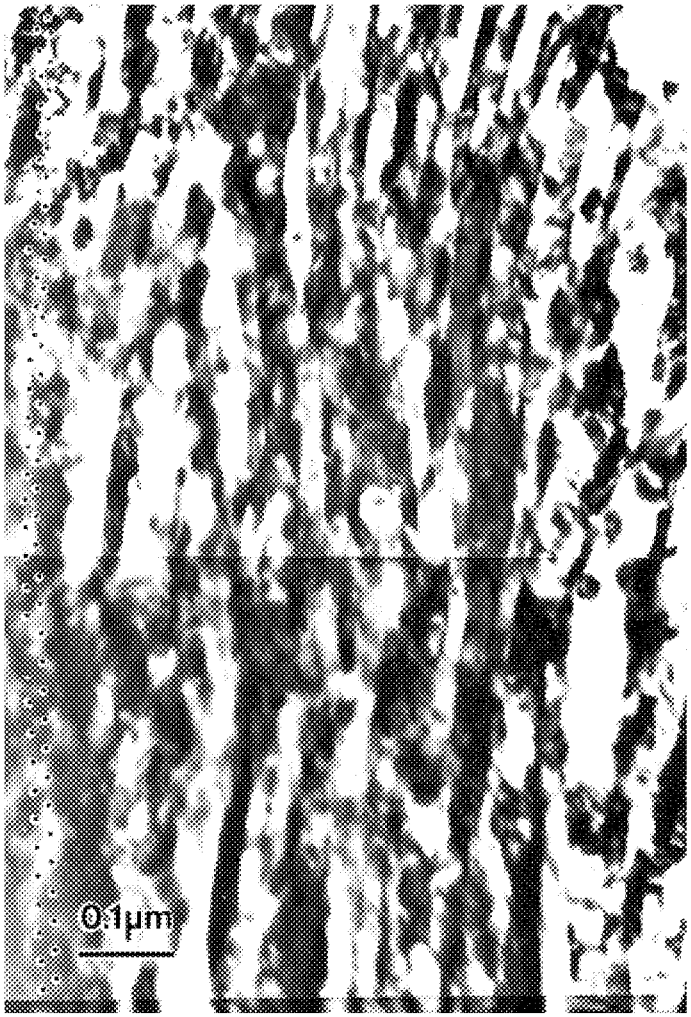
FIG. 5 is a photo micrograph showing deformation structure below the surface.
Figure 6:
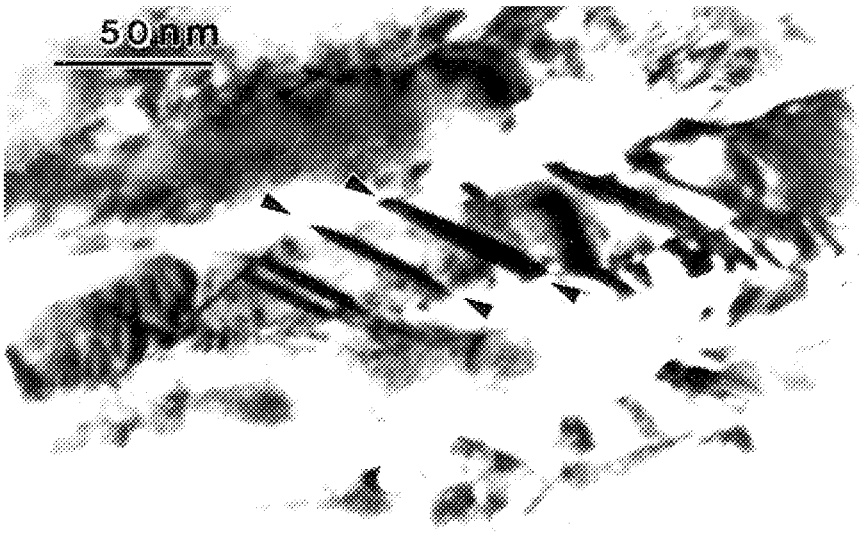
FIG. 6 shows a photo micrograph with very fine lamellar boundaries immediately below the surface which are nearly parallel to the sliding direction.
Figure 7:
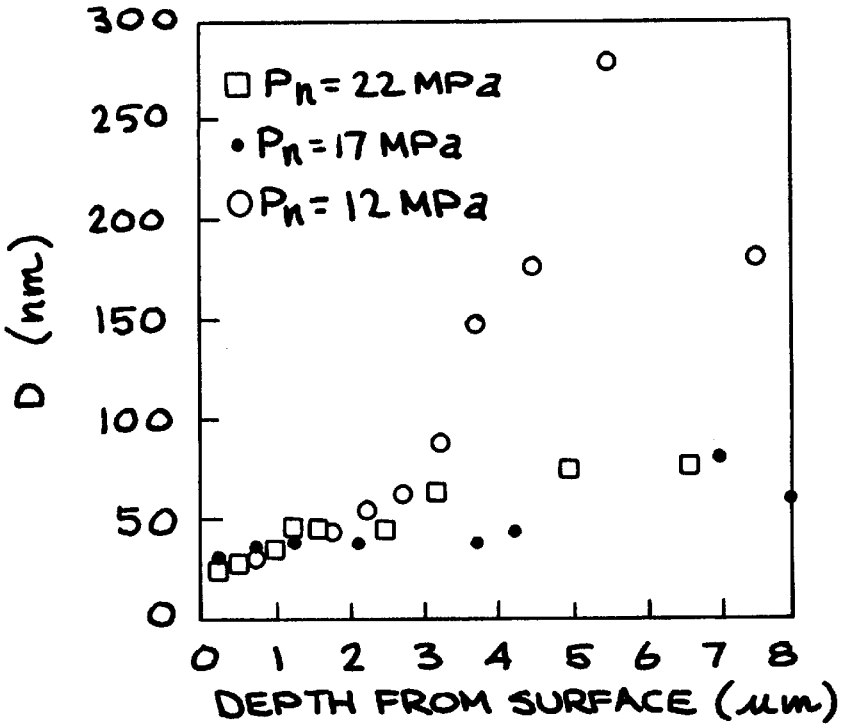
FIG. 7 is a graph showing the depth from a surface versus spacing of dislocation boundaries for different normal pressures.
Figure 8A:
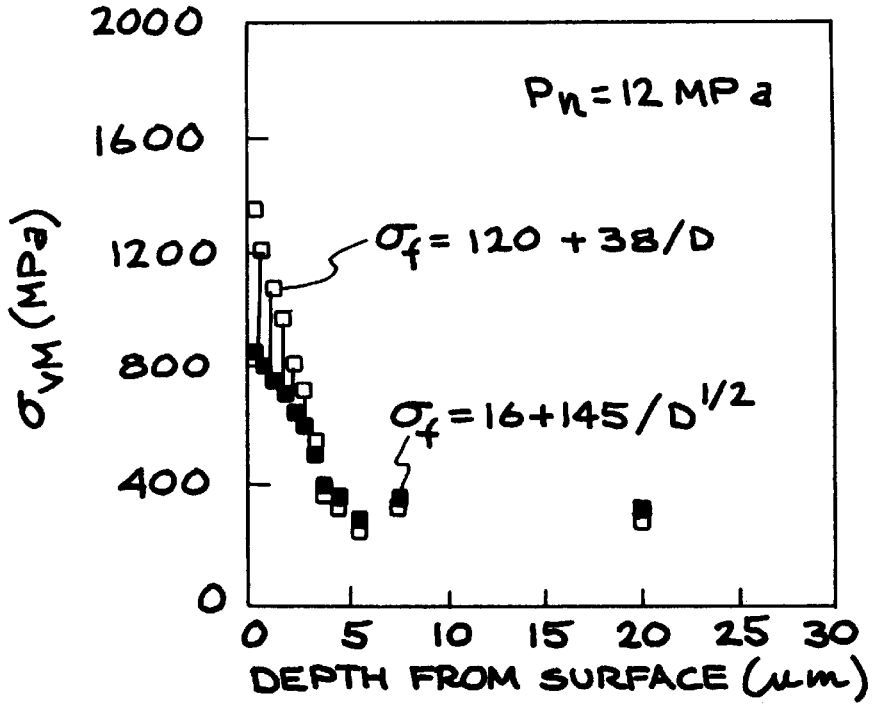
FIG. 8 shows a graph of the equivalent flow stress of copper as a function of the depth below the surface based on the spacing of lamellar boundaries and equiaxed subgrains.
Figure 8B:
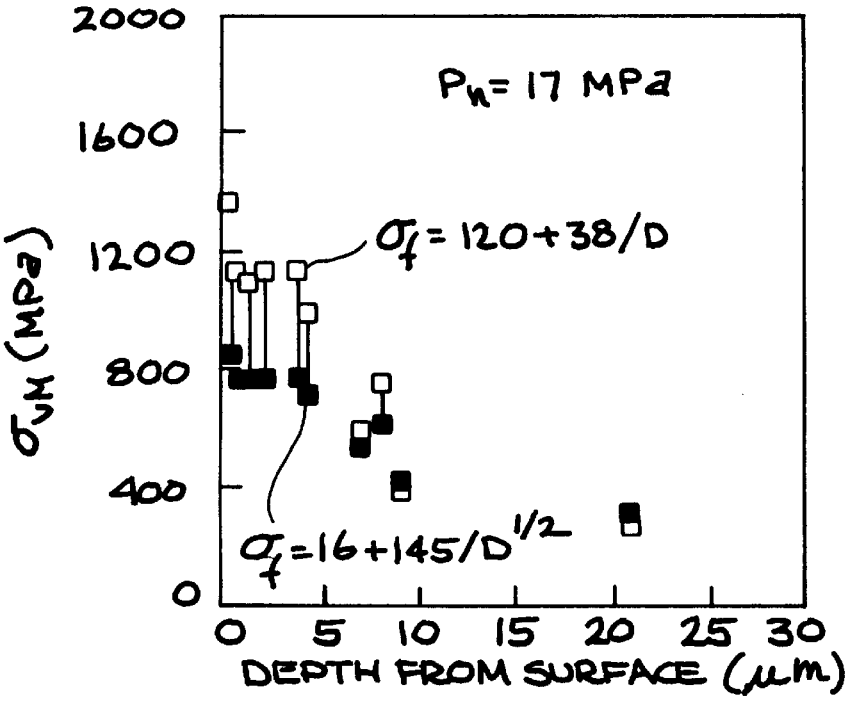
Figure 8C:
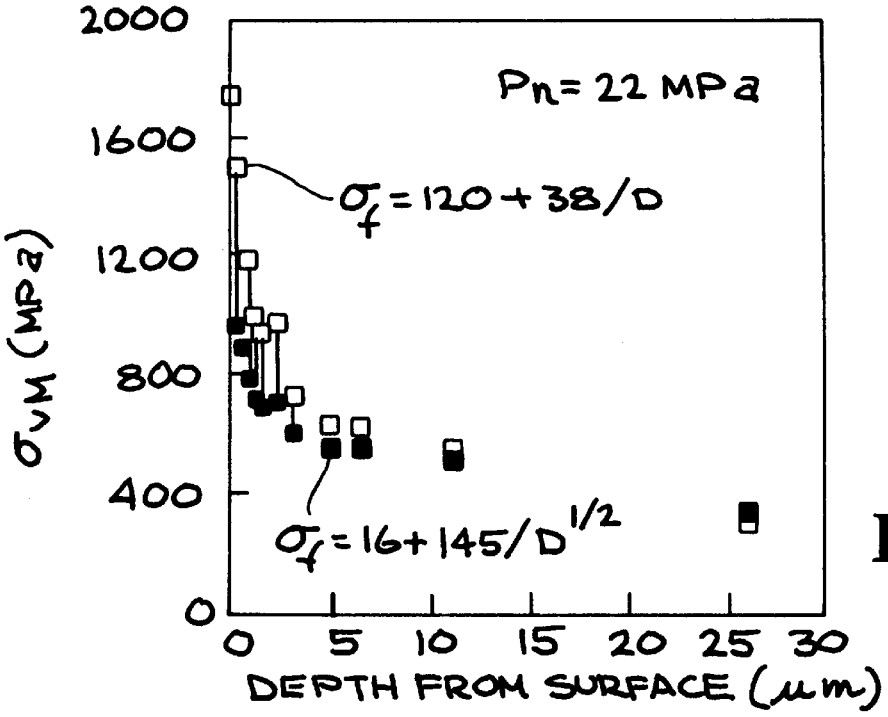

The new material, which is nearest the surface at a depth less than 15 $\mu$m, has a structure too fine to resolve using the SEM and thus appears as a bright band of contrast below the dotted line in FIG. 3. Those finest structures comprising the new material have been viewed in the TEM and are shown for example in FIGS. 5 and 6. FIG. 5 shows that finely spaced higher angle dislocation boundaries develop during the hardening process just below the surface. The surface is indicated by a dotted line in FIG. 5. These boundaries form elongated (lamellar) and equiaxed subgrains within the material. A higher magnification view of a similar region is shown in FIG. 6. Deformation twins are observed between the dislocation boundaries in FIG. 6. The spacing of these boundaries as a function of depth below the surface is plotted in FIG. 7 for three different normal pressures. The spacing of the boundaries increases steadily with depth below the surface, from 24 nm at a depth of 0.25 $\mu$m below the surface to about 75 nm at a depth of 8 $\mu$M for the highest pressure. Both the fineness of the new material and the depth at which that fine structure is observed increases with increasing normal pressure as indicated in FIG. 7. Thus, regions of fine nanometer scale microstructures can be created with depths from 1.5 to 15 $\mu$m below the surface.

The strength of the new material can be determined by finding a relation between subgrain size, D, and flow stress. Flow stress and corresponding von Mises stress can be determined using the following simple single-parameter empirical relation:

$$\sigma_f=\sigma_o+KGb/D^n \quad (1)$$

where, sigma_o is a friction stress, K is constant, b is Burger's vector, and G is the shear modulus. The exponent, n, has been found to vary from 0.5 to unity. Where, as is the case here, large strains (see FIG. 4) are observed in the near-surface region one can assume a stage IV hardening regime. For stage IV hardening, an exponent of unity has been observed for lamellar dislocation boundaries and equiaxed subgrains. In addition, several special attributes have been observed for stage IV hardening rates. In particular when scaled by shear modulus, the hardening rates are relatively insensitive to grain size, material purity, strain rate and small changes in temperature. Values of D and stress from empirical measurements have been used to fit Eq. 4. The resulting equation is:

$$\sigma_{vM}=120\text{MPa}+37.5\text{MPa}\mu\text{m}/D \quad (2)$$

An alternative relation suggested by Kuhlmann-Wilsdorf and Hansen suggests that the class of dislocation boundaries with relatively high angular misorientations—which include lamellar dislocation boundaries and subgrain boundaries observed—may have a strengthening effect equivalent to that of grain boundaries. In this case the exponent would be 0.5. The slope of the equation, the combined product of KGb, can then be approximated by the Hall-Petch slope for grain size hardening. An average value for the Hall-Petch slope for copper is 145 MPa$\mu$m$^{0.5}$. The resulting equation is:

$$\sigma_{vM}=16\text{MPa}+145\text{MPa}\mu\text{M}^{0.5}/D^{0.5} \quad (3)$$

Errors for both Eqs. 4 and 5 are estimated to be between ±20% for subgrain sizes similar to those in the literature and increasing to ±50% for regions where D is much less than the values of the literature.

The observed subgrain spacing, D, are shown in FIG. 7 as a function of depth from the surface. These measurements are applied to Eqs. 4 and 5 and the combined data is used to plot stress as a function of depth from the surface in FIG. 8. Both equations demonstrate that near surface layers have work hardened tremendously compared with the initial yield stress of 30 MPa. The stress values are 30–60 times the nominal applied von Mises stress shown in FIG. 1. Thus, based on the grain size and known microstructural scaling laws, one can approximate the relative strength of the new material.

To ensure the accuracy, Eqs. 4 and 5 are checked with independent empirical observations of deformation twins in the block subsurface. Single crystal studies have shown that the formation of deformation twins in copper requires a minimum critical resolved shear stress of 150 MPa. Deformation twins formed during shock loading of copper were also found to follow this criterion. Based on an average Taylor factor of three, a resolved shear stress of 150 MPa translates to an equivalent stress of 450 MPa. The maximum depth at which deformation twins were observed was noted. This depth is then applied to the results of FIG. 7 to determine the corresponding stresses which are derived from Eqs. 4 and 5. Table 3 shows the stress estimates which would result by applying Eqs. 4 and 5 at the observed depth.

TABLE 3

Comparisons of Stress Estimates with the Threshold Formation Stress

| Normal Pressure (MPa) | Maximum Depth Deformation Twins Observed ($\mu$m) | Estimated Stress at Observation Depth from Eq. (4) (MPa) | Estimated Stress at Observation Depth from Eq. (5) (MPa) |
|---|---|---|---|
| 12.0 | 3.5 | 462 | 450 |
| 16.7 | 8.5 | 438 | 435 |
| 21.5 | 12.5 | 524 | 490 |

These results indicate good agreement and independently check the accuracy of Eqs. 4 and 5.

There is a distinct pattern of stress and strain induced microstructures which develop as a result of stress gradients imposed by sliding. It was found that existing asperity deformation models which consider a moving wave can explain one contribution to friction coefficients, the friction induced stress gradients, and the depth of the new material. However, the microstructural observations also show that another contribution is required to match the friction values and the observed stress and strain field. It is postulated that local adhesion is another necessary factor. The observed microstructures reveal the tremendous potential for continued strain hardening of metals during confined deformation. This ability of materials to continue strain hardening beyond expectations, coupled to the potential for an ever increasing stress field at surface discontinuities means that a tremendously hard surface layer evolves during sliding.

Also, it is generally known that increased strength in metals corresponds to increased hardness. Specifically, it is known that hardness increases nonlinearly with increasing strength. An exact relation between hardness and strength for a given material would require experimental or modeling evidence or both. Thus, the strengthened subsurface region is harder in comparison to its state before processing. However, the exact hardness has not been determined.

The above has been a detailed discussion of the invention. The following claims and their equivalents are intended to define the full scope of the invention to which applicant(s) are entitled.

What is claimed is:

1. A new material comprising:

a. a substrate of original material with a first crystalline structure; and b. a surface portion of the original material having a second crystalline structure of a finer structure than that of said substrate and integral with said substrate said surface portion being formed by a confined sliding heavy loading physical deformation of said original material.

2. The material according to claim 1 wherein said surface portion has a strength of at least 10 times that of said original material.

3. The material according to claim 1 wherein the surface portion of said material is less than about 15 $\mu$m deep.

4. The material according to claim 1 wherein said original material is a metal.

5. The material according to claim 1 wherein said surface portion includes in addition to said finer crystalline structure, portions of another metal to form an alloy with at least a part of said surface portion.

6. The material according to claim 5 wherein said alloy is formed by transferring metal from a tool used to impart said sliding, heavy loads.

7. The material according to claim 6 wherein said other metal appears in a relatively consistent manner throughout at least said part of said surface portion.

8. A method for imparting strength to the surface of a metal or metal alloy by surface modification, comprising:

a) arranging the metal to be treated such that a portion of its surface is confined and exposed to a tool;

b) applying a force to the metal being treated to create a pressure normal to the interface between the portion of the metal surface and the tool; and c) sliding the tool along the confined portion of the metal surface to impart a shear force to the confined portion of the metal surface sufficient to create shear deformation of the metal surface.

9. The method of claim 8, wherein said steps of applying and sliding take place at room temperature.

10. The method of claim 8, wherein said steps of applying and sliding are accomplished at levels sufficient to increase the strength of the surface of the metal to at least about 10 times greater than the original metal surface.

11. The method of claim 8, wherein said steps of applying and sliding are accomplished at levels sufficient to create a fixed surface layer having a thickness of less than about 15 $\mu$m thick.

12. The method of claim 11, wherein said steps of applying and sliding are accomplished at levels sufficient to create a fine microstructure in the fixed surface layer having less than about 100 nm spacing.

13. The method of claim 8, wherein the sliding speed is between about 0.25 mm/s-25 mm/s.

14. The method of claim 8, wherein said step of applying imparts a pressure between about 20%–75% of a yield pressure for the metal.

15. The method of claim 8, further comprising controlling the surface finish of the tool, including the fine scale asperity geometry of the tool, to obtain the desired level of hardness of the surface of the metal to be treated.

16. The method of claim 15, wherein the tool has a blanchard ground surface finish having $R_q$ about 1.4 $\mu$m, $R_a$ about 1 $\mu$m, $R_p$ about 3 $\mu$m, the average number of peaks greater than 0.5 $\mu$m above the zero line about 8/mm, the average number of peaks greater than 1.25 $\mu$m above the line about 2/mm, and the wedge angle of the asperities between about 1° and 5°, where;

$R_q$ is the root mean square deviation of the roughness profile, $R_a$ is the arithmetic average of the absolute values of the measured profile height, and $R_p$ is the average maximum peak height.

17. The method of claim 8, wherein the metal to be treated is selected from the group consisting of copper, stainless steel, 6061 aluminum alloy and precipitation strengthened copper-beryllium alloy.

18. A method for forming an alloy on the surface of a metal, comprising the steps of:

a) arranging a metal to be treated such that a portion of its surface is confined and exposed to a tool;

b) applying a normal force to the metal being treated to create a pressure normal to the interface between the portion of the metal surface and the tool; and c) sliding the tool along the confined portion of the metal surface to impart a shear force to the confined portion of the metal surface sufficient to create shear deformation of the metal surface and to transfer material from the tool to the surface of the metal being treated, thereby forming an alloy on the surface of the metal.

19. The method of claim 18, wherein said steps of applying and sliding take place at room temperature.

20. The method of claim 18, wherein the surface alloy includes the material comprising the tool substantially uniformly distributed throughout the surface of the metal being treated.

21. The method of claim 18, wherein the surface alloy consists of 1 wt % iron in copper.

* * * * *